United States Patent [19]

Bohnhoff

[11] Patent Number: 4,896,993

[45] Date of Patent: Jan. 30, 1990

[54] MAT FOR PROVIDING A STABILIZED SURFACE OVER SAND OR OTHER LOOSE SOIL AND METHOD OF FABRICATING THE SAME

[76] Inventor: William W. Bohnhoff, 12501 E. Amherst Cir., Aurora, Colo. 80014

[21] Appl. No.: 110,434

[22] Filed: Oct. 20, 1987

[51] Int. Cl.[4] ..... E01C 5/20; E02B 3/14

[52] U.S. Cl. ..... 404/33; 404/35; 405/19; 405/258

[58] Field of Search ..... 405/15, 16, 17, 19, 405/258; 404/32, 33, 35

[56] References Cited

U.S. PATENT DOCUMENTS

| | | | |
|---|---|---|---|
| 4,329,392 | 5/1982 | Bronner | 405/19 X |
| 4,610,568 | 9/1986 | Koerner | 405/19 |
| 4,621,942 | 11/1986 | Hill | 404/35 X |
| 4,798,498 | 1/1989 | Hallberg | 405/258 |

FOREIGN PATENT DOCUMENTS

| | | | |
|---|---|---|---|
| 1928014 | 12/1970 | Fed. Rep. of Germany | 405/19 |
| 2410331 | 9/1974 | Fed. Rep. of Germany | 404/35 |
| 2818793 | 11/1979 | Fed. Rep. of Germany | 405/19 |
| 45684 | 11/1980 | Japan | 405/19 |

*Primary Examiner*—David H. Corbin

[57] ABSTRACT

A mat for providing a stabilized surface on sand or other loose soil and adapted to support a person stationed thereon, such as a person in a wheelchair. The mat includes a skeletal layer fashioned in the form of a grid, which is stiff and inflexible, except that it may be rolled-up. The skeletal layer is adhesively sandwiched between two blankets geotextile fabrics which remain relatively cool when exposed to sunshine. The mat also includes a plurality of spaced tubular rings, each having a tubular end glued to one of the geotextile blankets. A method of fabricating the mat is also disclosed.

22 Claims, 3 Drawing Sheets

MAT FOR PROVIDING A STABILIZED SURFACE OVER SAND OR OTHER LOOSE SOIL AND METHOD OF FABRICATING THE SAME

BACKGROUND OF THE INVENTION

The mobility of many physically impaired persons is severely restricted on sandy surfaces such as beaches. Physically feeble persons, such as the elderly, find it extremely difficult to walk in the sand because the sand tends to give way and become displaced when pressure is placed upon one's foot during walking. This problem is even more acute for persons who can walk only with the aid of canes, crutches or walkers, and is especially acute for persons in wheelchairs. It is virtually impossible to roll a wheelchair over a sandy beach, even with the help of an able bodied person pushing the wheelchair. Wheelchairs tend to sink several inches into the sand, and any rocking motion of the wheelchair tends to sink the wheel chair even deeper into the sand. Consequently, many physically impaired persons have avoided beaches and have been effectively precluded from participating in all the pleasurable activities associated with beaches.

In an effort to provide physically handicapped persons with access to beaches, the U.S. Army Corps of Engineers has installed landing mats consisting of a series of metal bars arranged in a parallel, side-by-side arrangement with their ends banded together by wire or cable. These landing mats have several drawbacks. They tend to become extremely hot to the point of being unusable. Also, the landing mats are heavy, cumbersome to transport, and expensive. Moreover, once the landing mat is placed in position on the beach, the landing mat is difficult to move, with the undesirable result that physically handicapped persons are confined to the boundaries of the landing mat. So-called "sand ladders" have also been used to permit physically handicapped persons access to beaches. The sand ladders are in all respects similar to the metal landing mats, except that wooden slats are substituted for the metal bars. The sand ladders suffer from the same drawbacks as the metal landing mats.

SUMMARY OF THE INVENTION

The present invention relates to a mat for providing a stabilized surface on sand or other loose soil and adapted to support a person stationed thereon, such as a person in a wheelchair. The mat includes a skeletal layer fashioned in the form of a grid, which is stiff and inflexible, except that it may be rolled-up. The skeletal layer is adhesively sandwiched between two blankets of geotextile fabrics which remain relatively cool when exposed to sunshine. The mat also includes a plurality of spaced tubular rings, each having a tubular end glued to one of the geotextile blankets. A method of fabricating the mat is also disclosed.

BRIEF DESCRIPTION OF THE DRAWINGS

The invention will be described with reference to the accompanying drawings, wherein.

DESCRIPTION OF A PREFERRED EMBODIMENT

Figure 1:
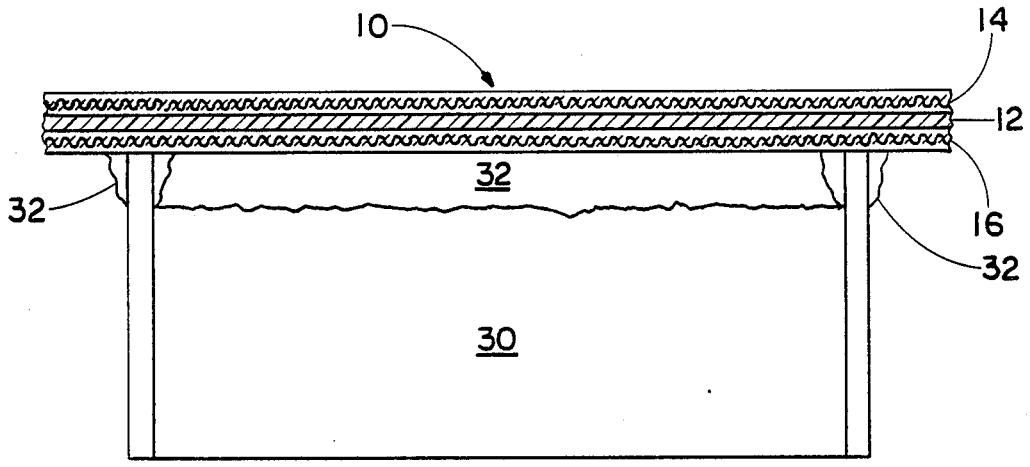
FIG. 1 is a partial cross-sectional view of a mat in accordance with one embodiment of the present invention.
Figure 7:
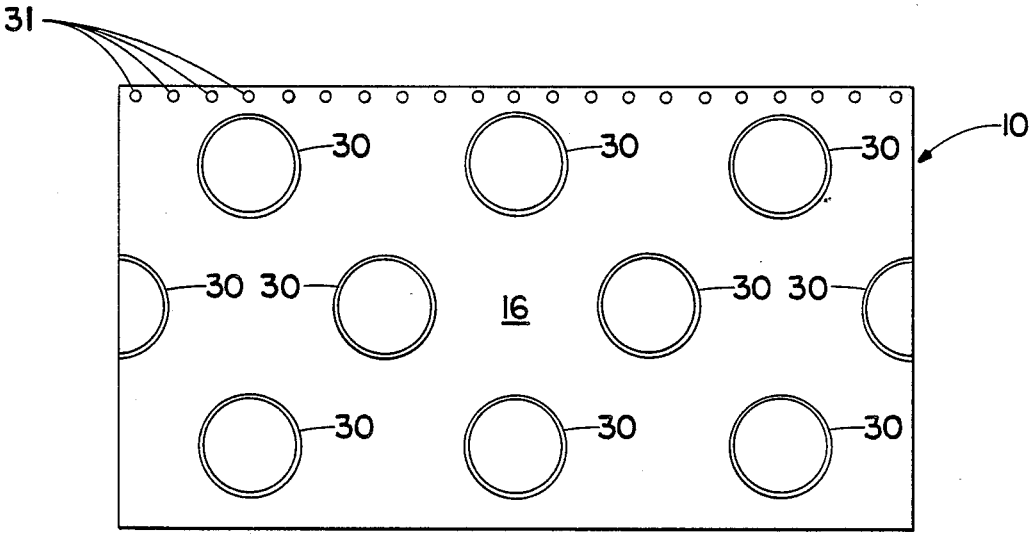
FIG. 7 is a partial bottom view of a mat in accordance with the present invention.

The invention will now be described with reference to the accompanying drawings wherein like reference numerals refer to the same item. There is shown in FIGS. 1 and 7 a mat 10 in accordance with one embodiment of the present invention. The mat 10 includes a skeletal layer 12 adhesively sandwiched between two blankets of geotextile material 14, 16.

Figure 2:
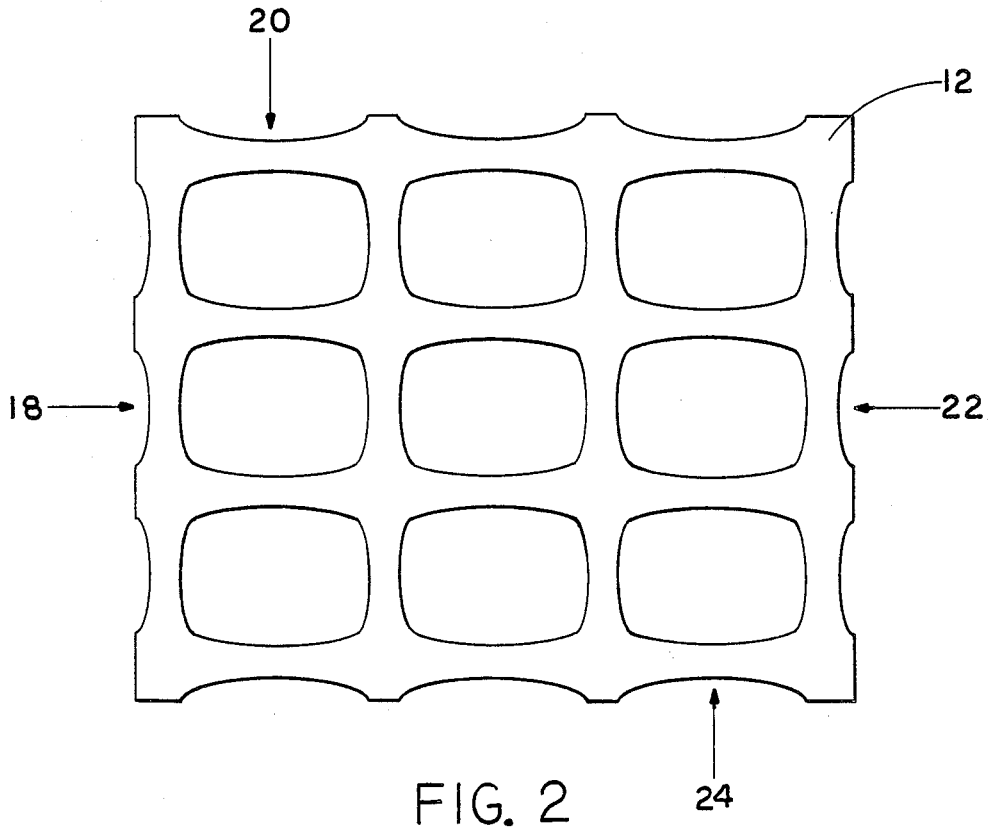
FIG. 2 is a partial top view of a skeletal layer utilized in the mat shown in FIG. 1.
Figure 3:
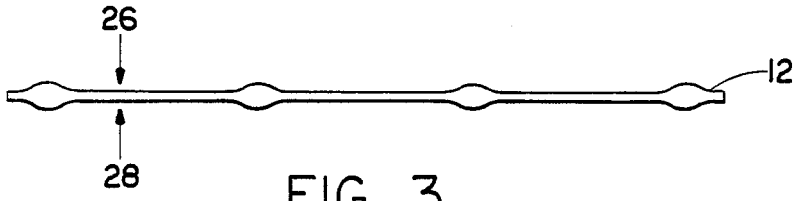
FIG. 3 is a side view of the skeletal layer shown in FIG. 2.

The skeletal layer 12 is relatively thin and is fashioned in a grid or lattice configuration, as best shown in FIGS. 2 and 3. The intersticial openings in the grid are approximately one and one-quarter inches by one inch and the ribs defining the intersticial openings are about three-thirty seconds to one-quarter inch wide and one-thirty second to one-eighth inch thick. The skeletal layer 12 is stiff and rigid when forces are applied to the skeletal layer 12 in the directions within the plane of the skeletal layer 12. So, for example, if a force is applied to the skeletal layer 12 in the directions of any of the arrows 18, 20, 22, 24 as shown in FIG. 2, then the shape of the skeletal layer 12 will be unaffected. Nevertheless, the skeletal layer 12 is bendable when a force is applied in a direction perpendicular to the plane of the skeletal layer 12 so that the skeletal layer 12 may be rolled-up. Thus, if a force is applied to the skeletal layer 12 in the directions of either of the arrows 26, 28 as shown in FIG. 3, then the skeletal layer 12 will bend in response to such force.

The skeletal layer 12 may be fashioned from metal, such as a metal screen, or from plastics such as polypropylene or polyethylene. Plastic is preferred over metal, since metal is prone to oxidation (rusting) and is relatively heavy. It is also preferred that the skeletal layer 12 possess a memory retention such that the skeletal layer 12 strongly tends to assume a flat shape when the skeletal layer 12 has been deformed from a flat condition, such as when the skeletal layer 12 is rolled-up. Again, plastics are preferred over metals because of their memory retention properties. The skeletal layer 12 should possess a tensile strength in the range of 600 to 6,000 pounds per foot. A suitable skeletal layer 12 is the SS1 TENSAR GEOGRID brand plastic grid commercially made and sold by The Tensar Corporation located in Morrow, Ga.

The blankets 14, 16 of geotextile fabric material are preferably strong and resistent to tearing and puncturing. Such fabrics are light-weight, soft, nonabrasive, flexible and durable. Moreover, the geotextile fabrics are permeable to water, thereby minimizing the potential for water accumulation on the surface of the mat, which might cause a slippery surface. The geotextile fabrics are also fibrous, which provides some friction and minimizes the slipperiness of the mat surface even when dry. A suitable blanket 14, 16 comprises a TREVIRA SPUNBOND geotextile fabric material commercially made and sold by Hoechst Fiber Industries located in Spartanburg, S.C.

Although the blankets 14, 16 have been described as being fashioned of geotextile materials, it should be appreciated that other materials such as canvas and even indoor/outdoor carpeting may also be advantageously, though less desirably, used. Also, it should be appreciated that the invention contemplates a mat 10 in which either or both of the blankets 14, 16 are eliminated. In the preferred embodiment of the present invention, the skeletal layer 12 is compressibly interposed between the blankets 14, 16, and an adhesive such as glue bonds the blankets 14, 16 together in the regions of the intersticial openings of the skeletal layer 12. It will be appreciated that the skeletal layer 12 may be held together with either or both of the two blankets 14, 16 through alternative bonding means such as sewing, stapling, riveting, and the like.

Figure 4:
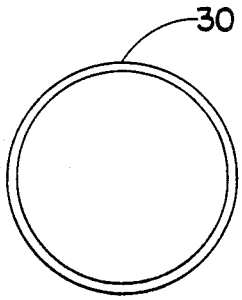
FIG. 4 is an end view of the tubular ring utilized in the mat shown in FIG. 1.
Figure 5:
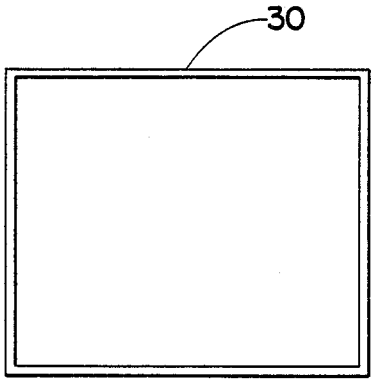
FIG. 5 is an end view of another tubular ring that can be used in connection with a mat in accordance with the present invention.
Figure 6:
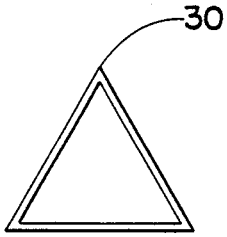
FIG. 6 is an end view of yet another tubular ring that can be used in connection with a mat in accordance with the present invention.

The mat 10 also includes a plurality of tubular rings 30. The walls of the ring 30 are preferably very thin, such as one thirty-second of an inch to permit the ring to protrude readily into sand or other soil. The width or diameter of each ring 30 is preferably in the range of one and one-half inches to five inches, and most preferably about three inches. The length of each ring 30 taken in a direction parallel to the axis thereof is preferably in the range of one-half inch to two inches, and most preferably about one inch. The rings 30 are preferably fashioned of plastic, which is inexpensive, lightweight and durable. The configuration of the tubular rings 30 taken from an end view (or when viewed in a cross-section taken in a plane perpendicular to the axis of the ring) may be any one of a variety of shapes such as circular, square, or triangular as shown in FIGS. 4, 5, and 6, respectively. A tubular end of each ring 30 is permanently affixed to the blanket 16 by means of adhesive 32. It is preferred that the rings 30 be adhered directly to the blanket 16 because the adhesive bond is stronger than if the rings 30 were adhered to the skeletal layer 12.

As best shown in FIG. 7, the tubular rings 30 are spaced from each other in array on the blanket 16. The rings 30 are arranged in rows, with the rings in any row being staggered with respect to the rings 30 in an adjacent row. The rings 30 are mounted in a diamond shape array as shown in FIG. 7. The distance between the central axes of adjacent rings 30 is preferably in the range of seven inches to twelve inches, and the distance between the walls of adjacent rings 30 is preferably in the range of two inches to six inches.

The mat 10 may also include a series of grommets 32 along at least one peripheral edge of the mat 10. The grommets 32 can be used to lace together adjacent mats 10.

In use, the mat 10 is placed on sandy or other loose soil with the rings 30 protruding into the soil. The rings 30 prevent the mat 10 from sliding laterally along the surface of the soil. The skeletal layer 12, to some degree in combination with the rings 30, provides a firm supporting surface so the mat 10 will not crumple or sag when bearing the weight of a person, such as a person in a wheelchair. The blanket 14 of geotextile fabric effectively eliminates the possibility of water ponding on the surface and provides some friction, so that the mat 10 is not slippery. Nevertheless, the blanket 14 is soft to touch, is not abrasive, and remains relatively cool when exposed to sunshine. The fact that the mat 10 does not slide laterally on the soil and is not slippery is especially important when the mat 10 is placed on sloped surfaces, such as beaches.

It will be appreciated that since the mat 10 is relatively light-weight and can be rolled-up, the mat 10 is readily transportable by a person. Also, because the skeletal layer 12 has a strong memory retention and tends to assume a flat shape, the mat 10 may be unrolled without the mat 10 becoming buckled or curled. It is contemplated that physically handicapped persons may use more than one mat 10 in order to move over sandy or loose soil. For example, a person in a wheelchair will place down a first mat 10, roll his wheelchair over the mat, place a second mat 10 immediately adjacent to the first mat 10 in the direction in which the person wishes to move, roll his wheelchair onto the second mat 10, pick up the first mat 10, place the first mat 10 immediately adjacent to the second mat 10 in the desired direction of movement, and continue in this manner until he arrives at the desired location. Several mats 10 may also be secured together to form a pathway or platform. When used in this manner, the mats 10 are secured together by fastening through the grommets 32.

One of the most striking aspects of the present invention is that the mats 10 can be placed at the water's edge, beneath the water. This use of the mats 10 permits a person in a wheelchair to wheel himself into the water, swim in the water with the wheelchair left resting on the mat 10, reseat himself in the wheelchair, and wheel himself out of the water—all without any external assistance.

Figure 8:
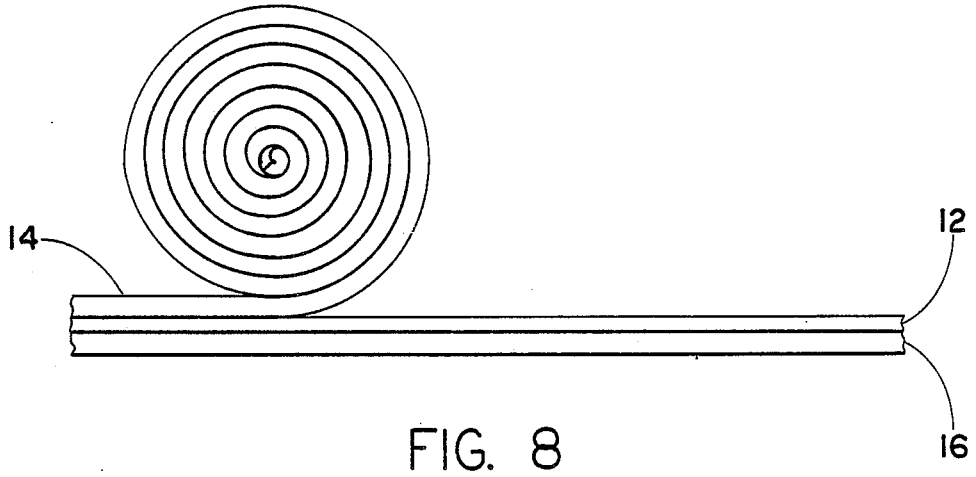
FIG. 8 is a side schematic illustration of a skeletal layer being adhesively sandwiched between two blankets of geotextile material during the fabrication of a mat in accordance with the present invention.

The present invention also contemplates a method of fabricating the mat 10. As shown in FIG. 8, the blanket 16 is laid flat, and a skeletal layer 12 is placed on top of the blanket 16, also in a flat condition. An adhesive is applied such as by spray roller or a brush on the top of the skeletal layer 12 and the blanket 16. The blanket 14, which is rolled-up, is then unrolled over the skeletal layer 12, whereby the blanket 14 is bonded by the adhesive to the blanket 16 in the intersticial regions of the skeletal layer 12. The tubular ends of the rings 30 are thereafter placed in abutment with the blanket 16 and an adhesive is applied to the abutting ends, whereby the rings are directly affixed to the blanket 16.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than as specifically described above.

I claim:

1. A mat for providing a stabilized surface over sand or other loose soil, said mat comprising a first layer of fiber material;

a layer of skeletal material, said skeletal layer being substantially stiff and rigid when subjected to forces along directions within the plane of said skeletal layer but being bendable when subjected to forces in a direction substantially perpendicular to the plane of said skeletal layer such that said skeletal layer may be rolled, said skeletal layer being affixed in an overlapping relationship to said first fiber layer; and means connected to first fiber layer and adapted to protrude into the loose soil for substantially preventing the lateral displacement of said mat along the surface of the loose soil.

2. A mat according to claim 1 wherein said displacement preventing means comprises a plurality of substantially tubular rings, each ring oriented such that the axis of each ring is substantially perpendicular to the plane of said first fabric layer and the plane of said skeletal layer.

3. A mat according to claim 2 wherein said rings are arranged in rows and wherein the rings in one row are staggered with respect to the rings in an adjacent row.

4. A mat according to claim 2 wherein said rings are directly connected to said first fiber layer.

5. A mat according to claim 4 wherein said rings are adhered to said first fiber layer.

6. A mat according to claim 2 wherein said rings each bear a substantially circular shape when viewed in a cross-section taken in a plane perpendicular to the axis of said rings.

7. A mat according to claim 6 wherein the diameter of said rings is substantially in the range of one and one-half inches to five inches.

8. A mat according to claim 2 wherein the length of each ring taken in a direction parallel to the axis thereof is substantially in the range of one-half inch to two inches.

9. A mat according to claim 2 wherein the spacing between the center of each ring and the center of the nearest other ring is substantially in the range of four inches to twelve inches.

10. A mat according to claim 1 wherein said skeletal layer is fashioned in a grid or lattice pattern.

11. A mat according to claim 10 wherein said skeletal layer comprises metal.

12. A mat according to claim 10 wherein said skeletal layer comprises a plastic.

13. A mat according to claim 10 wherein said skeletal layer comprises polypropylene.

14. A mat according to claim 1 wherein said skeletal layer possesses memory retention such that said skeletal layer substantially immediately, voluntarily unrolls from a rolled condition to a substantially flat condition.

15. A mat according to claim 1 wherein said skeletal layer possesses a tensile strength substantially in the range of six hundred to six thousand pounds per foot.

16. A mat according to claim 1 wherein said first fiber layer comprises a geotextile fabric.

17. A mat according to claim 1 wherein said first fabric layer and said skeletal layer are each permeable to water.

18. A mat according to claim 1 further comprising a second layer of fiber material, said skeletal layer being interposed between said first fiber layer and said second fiber layer.

19. A mat according to claim 1 further including means for selectively connecting said mat to another said mat.

20. A mat according to claim 19 wherein said selectively connecting means comprises a plurality of grommets disposed adjacent to the mat periphery.

21. A mat according to claim 1 wherein said mat is capable of being rolled and is transportable by a human when in a rolled condition.

22. A mat for providing a stabilized surface over sand or other loose soil, said mat comprising a sheet of material adapted to support a person stationed thereon, said sheet being substantially inflexible when subjected to forces along directions within the plane of said sheet but being flexible when subjected to forces in a direction substantially perpendicular to the plane of sheet such that said sheet may be rolled; and a plurality of tubular rings, each ring oriented such that the axis of each ring is substantially perpendicular to the plane of said sheet, each ring adapted to depend beneath said sheet of material and into the sand or other loose soil.

* * * * *